US006368086B1

(12) United States Patent
McInerney

(10) Patent No.: US 6,368,086 B1
(45) Date of Patent: Apr. 9, 2002

(54) UNIVERSAL PUMP BRACKET

(75) Inventor: Kevin McInerney, Mokena, IL (US)

(73) Assignee: Tuthill Corporation, Burr Ridge, IL (US)

( * ) Notice: Subject to any disclaimer, the term of this patent is extended or adjusted under 35 U.S.C. 154(b) by 0 days.

(21) Appl. No.: 09/767,097

(22) Filed: Jan. 22, 2001

(51) Int. Cl.[7] ..... F01C 13/00

(52) U.S. Cl. ..... 418/39; 418/104; 418/166; 418/171

(58) Field of Search ..... 418/39, 104

(56) References Cited

U.S. PATENT DOCUMENTS

| | | | | | |
|---|---|---|---|---|---|
| 1,087,181 | A | * | 2/1914 | Pitman | 418/39 |
| 1,624,099 | A | * | 4/1927 | Haight | 418/39 |
| 1,737,942 | A | * | 12/1929 | Pagel | 418/39 |
| 2,781,726 | A | * | 2/1957 | Bangs | 418/39 |
| 2,856,859 | A | * | 10/1958 | Baade et al. | 418/39 |
| 4,462,770 | A | * | 7/1984 | Haupt | 418/39 |
| 4,699,575 | A | * | 10/1987 | Geisel et al. | 418/104 |

FOREIGN PATENT DOCUMENTS

| | | | | |
|---|---|---|---|---|
| DE | 2622164 | * | 1/1977 | 418/39 |
| GB | 2121488 | * | 12/1983 | 418/104 |

* cited by examiner

*Primary Examiner*—Thomas Denion
*Assistant Examiner*—Theresa Trieu
(74) *Attorney, Agent, or Firm*—Lee, Mann, Smith, McWilliams, Sweeney and Ohlson

(57) ABSTRACT

This invention is directed to a pump bracket that is adapted to allow for the inboard or outboard mounting of a mechanical seal or packing material to accommodate different pump configurations and applications. The universal pump bracket includes a first flange that is adapted to be connected to a pump housing and a second flange, which is laterally displaced from the first flange and adapted to be connected to a bearing carrier. If an inboard mechanical seal or inboard packing arrangement is desired, the bracket can be installed so the seal is facing the inboard direction. Alternatively, if an outboard seal arrangement is desired, the bracket can be installed on the rotor so the seal or packing faces the outboard direction.

15 Claims, 3 Drawing Sheets

UNIVERSAL PUMP BRACKET

BACKGROUND OF THE INVENTION

This invention relates to an improved pump bracket. More particularly, this invention relates to an improvement in the design of a gear pump's internal bracket such that one bracket design can be used for various pump sealing options.

In a rotary internal gear pump, a pump housing is connected to a bearing carrier by use of a bracket. Depending upon the pump configuration or application, an inboard or outboard mechanical seal arrangement may be needed to allow for proper pump operation. Also for certain applications, an outboard packing arrangement may be utilized to effectively seal the pump housing. To accommodate the different requirements for seal arrangements, several different bracket designs are typically produced to allow for the repositioning of the seal and packing material depending on whether an inboard or outboard arrangement is needed and whether mechanical seals or packing is to be utilized.

Previous bracket designs have accomplished the repositioning of the seals from an inboard to an outboard position by producing separate brackets for each application or pump design. These designs require the manufacturer to produce and inventory several models of brackets which is costly and consumes storage space.

A need has arisen for an improved design for a pump bracket. The present invention discloses an improved design for a bracket for a pump that allows the repositioning of the seal or packing material from an inboard to an outboard position utilizing a reversible pump bracket adapted to accommodate different arrangements.

SUMMARY OF THE INVENTION

The disclosed pump bracket is adapted to allow for the inboard or outboard mounting of a mechanical seal or packing material to accommodate different pump configurations and applications. The application disclosed herein is for use with an internal gear pump but such a bracket can be used with external gear pumps, vane pumps, gerotor pumps etc. The universal pump bracket includes a first flange that is adapted to be connected to a pump housing and a second flange, which is laterally displaced from the first flange, and adapted to be connected to a bearing carrier. The first and second flanges are separated by the central bridge of the bracket. The bracket also includes a central bore that extends through the bracket and is adapted to receive the input shaft which drives the rotor of the pump. The central bore is adapted to accept a bushing. The bushing is provided to aid in supporting the shaft to prevent unwanted movement. A first annular recess is formed in the central bore and is adapted to accept a mechanical seal or a packing material. The mechanical seal is equipped with a spring to apply pressure to the sealing surfaces to prevent unwanted leakage.

The reversible first and second flanges are designed so that they have similar mounting faces and the same bolt patterns thereby allowing the bracket to be reversed so the first flange is in contact with the pump housing and the second flange is in contact with the pump bearing carrier. The benefit of this reversible arrangement is to allow the same bracket to be used with different pump configurations. If an inboard mechanical seal arrangement is desired, the bracket can be installed so the seal is facing the inboard direction. Alternatively, if an outboard seal arrangement or packing arrangement is desired, the bracket can be installed so the seal or packing faces the outboard direction. The reversibility of the bracket allows the bracket to be used for multiple sealing arrangements, eliminating the need to manufacture and store multiple separate bracket designs.

DETAILED DESCRIPTION OF THE PREFERRED EMBODIMENT

While the present invention will be described fully hereinafter with reference to the accompanying drawings, in which a particular embodiment is shown, it is understood at the outset that persons skilled in the art may modify the invention herein described while still achieving the desired result of the invention. Accordingly, the description which follows is to be understood as a broad informative disclosure directed to persons skilled in the appropriate arts and not as limitations of the present invention.

Figure 1:
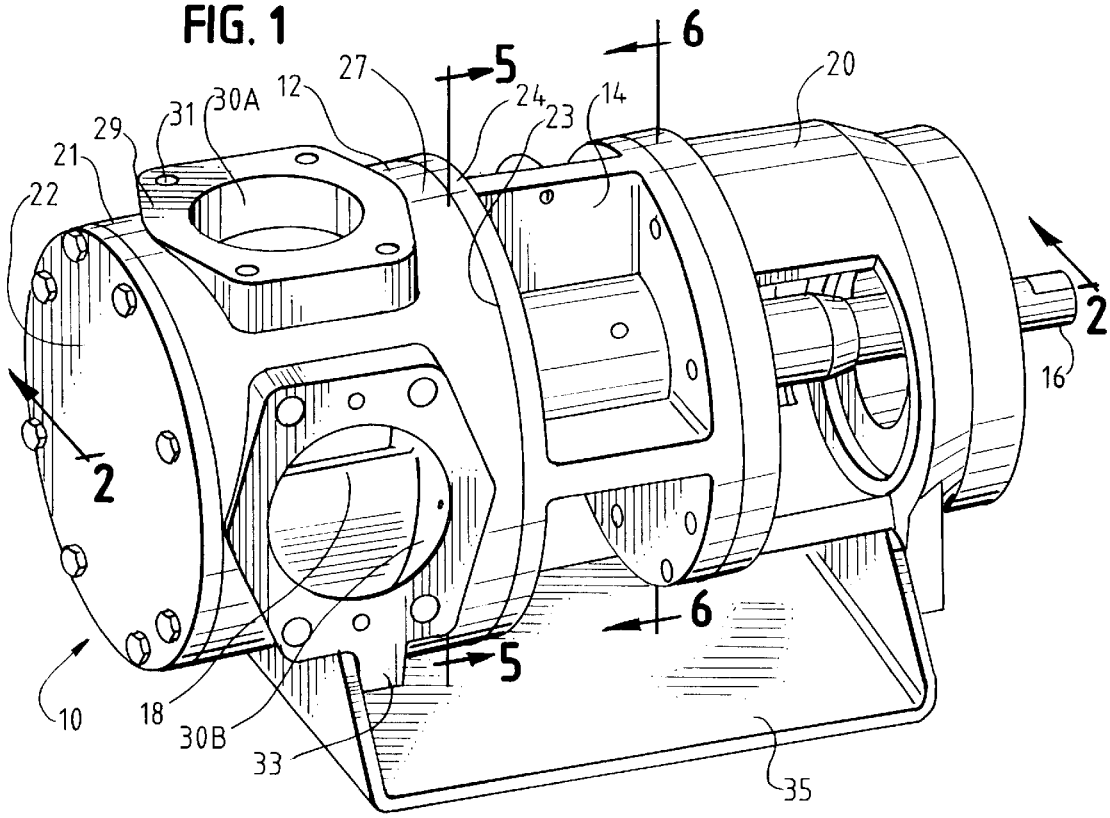
FIG. 1 is a perspective view of an internal gear pump illustrating the universal bracket of the present invention.

The present invention is directed to a bracket for an internal gear pump which is adapted to provide for a universal mounting arrangement which allows a seal to be mounted in an inboard or an outboard configuration. A packing arrangement can also be mounted in an outboard configuration. The bracket of the present invention is illustrated and described in the operational embodiment of an internal gear pump as described herein but is believed to have broad application above and beyond the description of this preferred embodiment. As shown in FIG. 1, the internal gear pump of the preferred embodiment, generally designated with the numeral 10, includes a pump housing 12, a bracket 14, an input shaft 16, a rotor 32 and a bearing carrier 20. The pump housing 12 includes a first end 21 which is closed by an end plate 22 and a second end 23 to which is secured a first flange 24 of the bracket 14. The pump housing 12 has an internal surface 26, shown in FIG. 2, that defines the outer diameter 28 of the rotor 32. The exterior surface 27 of the pump housing 12 includes several passageways 30*a* and 30*b* that provide passageways for incoming and outgoing fluid. The passageways 30*a* and 30*b* can function as inlets or outlets depending on the direction of pump rotation. The passageways 30 have surfaces 29 that are planar and have apertures 31 to allow for the attachment of ports or other conduits (not shown). The exterior surface 27 further includes a flange 33 that allows for the attachment of a foot 35. The foot 35 is a U-shaped member that provides a stable foundation for the pump 10. The foot 35 is used to support the pump 10 and prevent movement during operation. It is permanently secured with fasteners. The end plate 22 seals the first end 21 of the pump housing 12 and provides an idler pin for mounting an idler gear.

Figure 2:
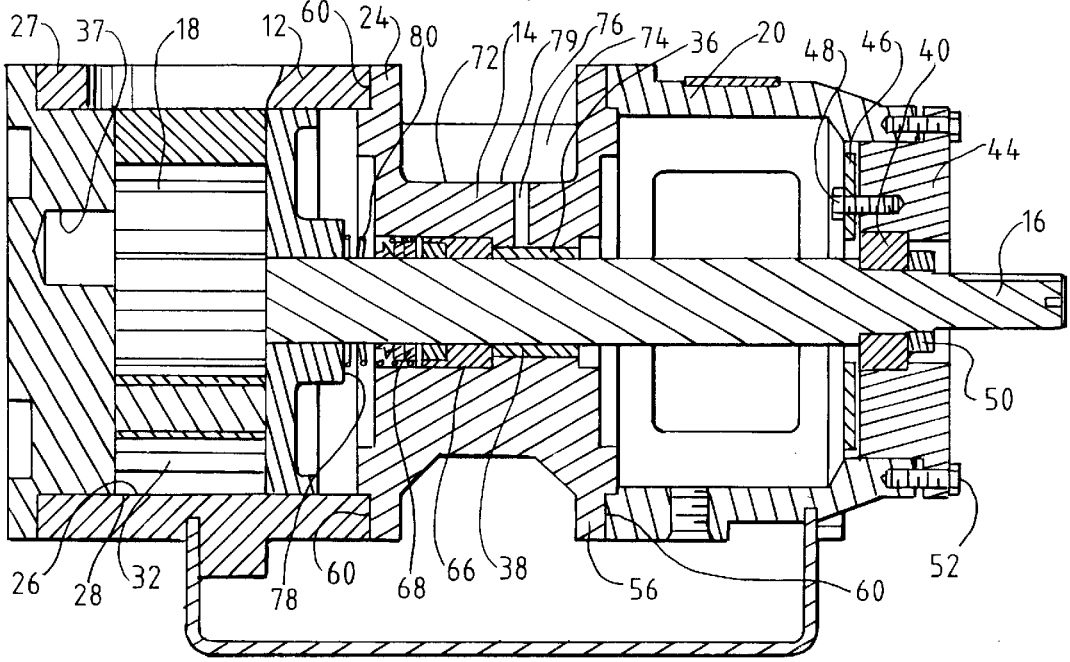
FIG. 2 is a cross-sectional view of the internal gear pump of FIG. 1 taken along the lines 2—2 of FIG. 1 which includes a bushing with a mechanical seal in an inboard configuration.

The input shaft 16, shown in FIG. 2, is rotatably disposed within the pump housing 12, the bracket 14 and the bearing carrier 20 and is adapted to rotate about its central axis. The rotor 32 includes a cup-shaped member 18. The input shaft 16 is supported by abushing 36 that is disposed within a central bore 38 of the bracket 14. The bushing 36 allows the input shaft 16 to extend therethrough and supports the shaft 16 to allow rotation. The shaft 16 is also supported by a bearing 40. Bearing 40 allows the input shaft 16 to extend therethrough and supports the shaft 16 to allow rotation. The combination of the bushing 36, and the bearing 40 provide for a stable support of rotor 32 to prevent unwanted movement. The bearing 40 is retained in an end cap 44 by use of a retaining ring 46. The retaining ring 46 is secured into place by use of bolts 48. The input shaft 16 also includes a locknut 50 that is in contact with the bearing 40 to secure it along the shaft. The bearing end cap 44 can be removed from the bearing carrier 20 by removing bolts 48 and sliding the end cap 44 off of the input shaft 16. Once the bearing end cap 44 is removed, the retaining ring 46 can be unbolted, allowing the bearing 40 to be removed.

Figure 3:
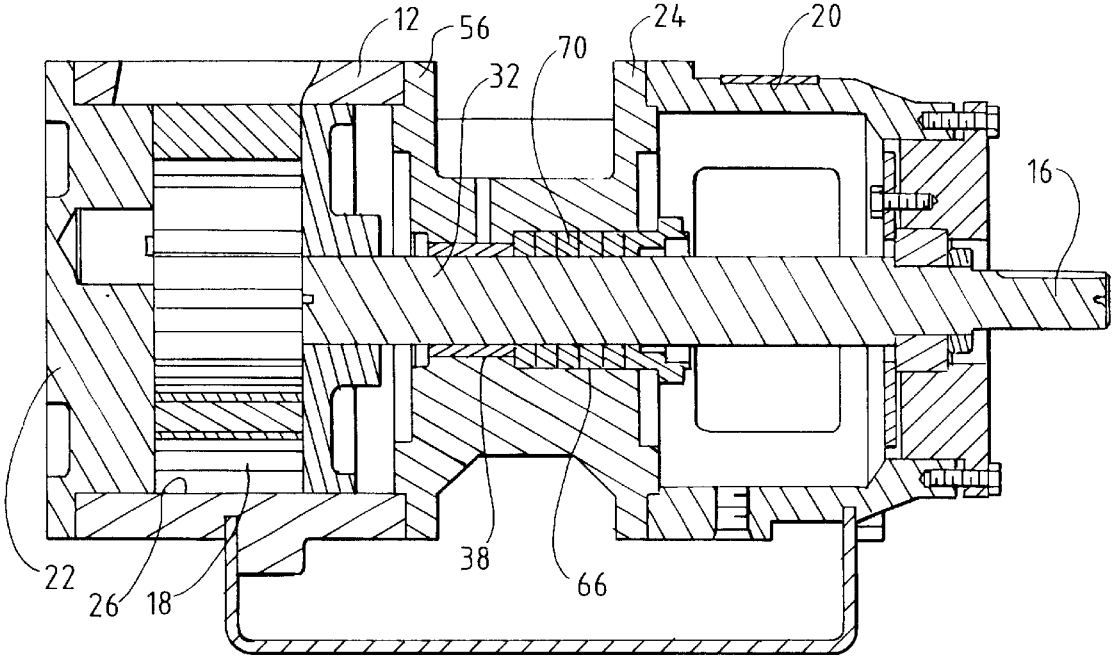
FIG. 3 is a cross-sectional view of an internal gear pump which includes a bushing with the packing material in an outboard configuration.
Figure 4:
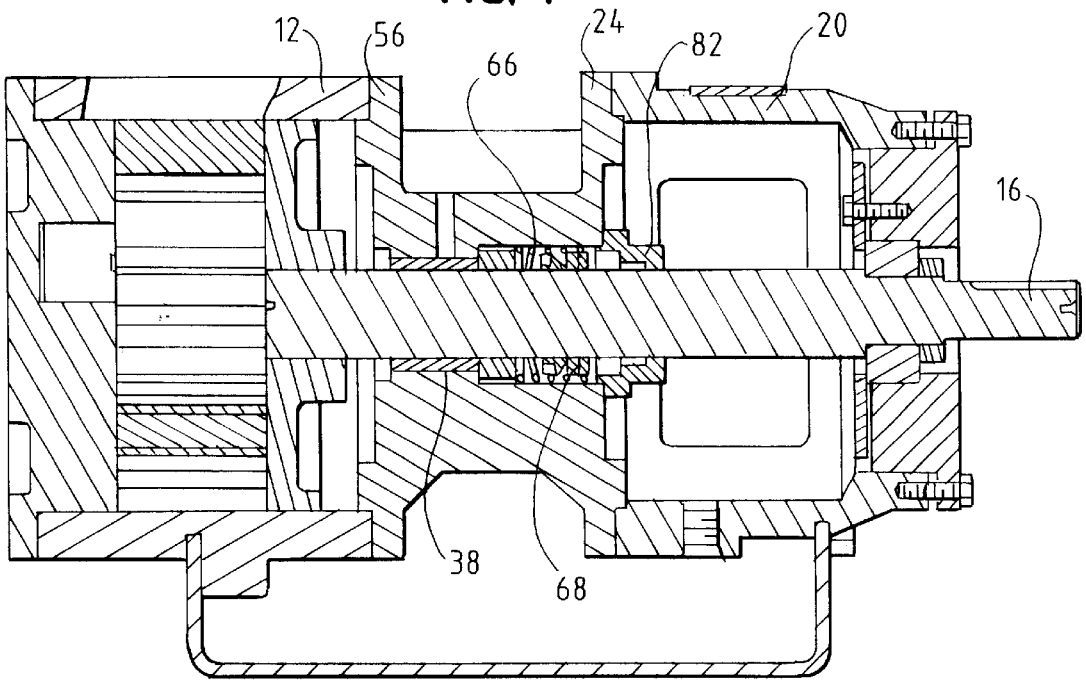
FIG. 4 is a cross-sectional view of an internal gear pump which includes a bushing with the mechanical seal in, an outboard configuration.
Figure 5:
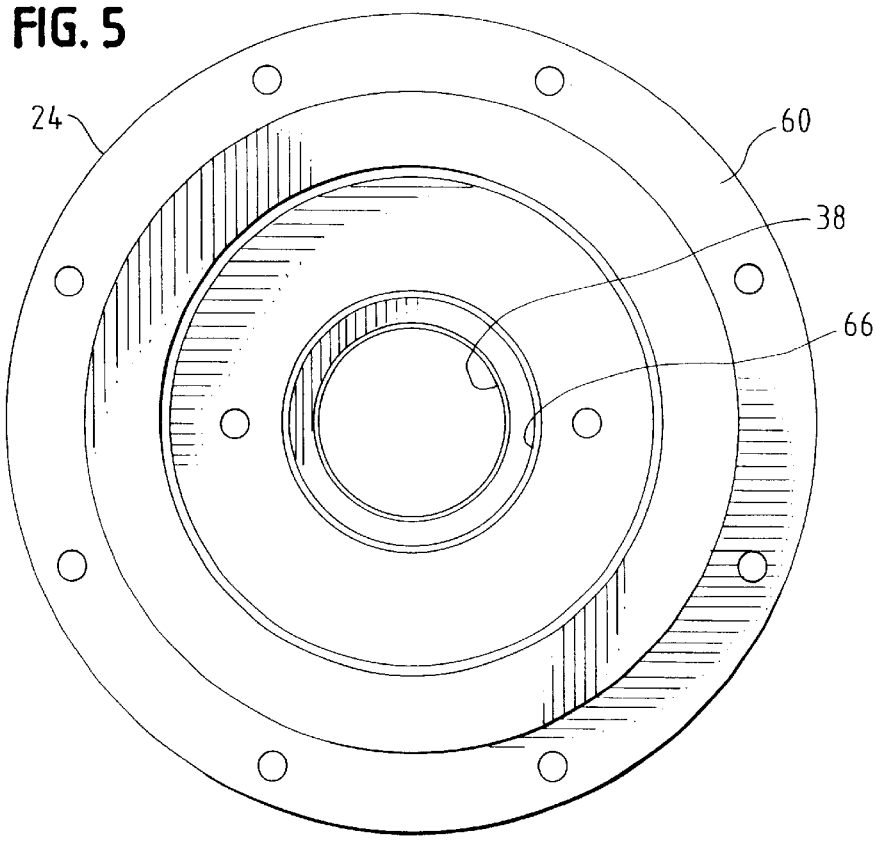
FIG. 5 is an end view of the universal bracket taken along lines 5—5 of FIG. 1.
Figure 6:
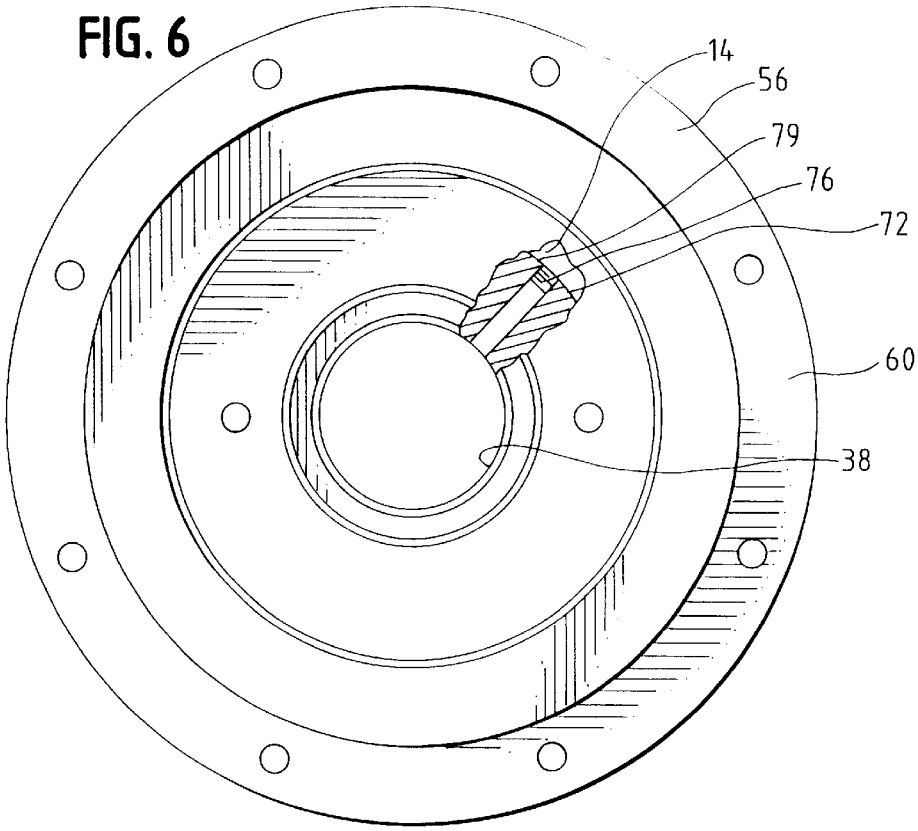
FIG. 6 is an end view of the universal bracket taken along lines 6—6 of FIG. 1.

The bracket 14 connects to the pump housing 12 and to the bearing carrier 20. The bracket 14 is mounted to the pump housing 12 in FIGS. 1 and 2 by use of the first flange 24. The first flange 24 is connected to the pump housing 12 by use of bolts (not shown). The bracket 14 is connected to the bearing carrier 20 in FIGS. 1 and 2 by use of a second flange 56. The second flange 56 is connected to the bearing carrier 20 by use of bolts (not shown). The first flange 24 and the second flange 56 have the same connecting surfaces and bolt patterns so as to allow the first flange 24 to be connected to the bearing carrier 20 as shown in FIGS. 3 and 4 and the second flange 56 to be connected to the pump housing 12, which is a reversal of the arrangement shown in FIGS. 1 and 2. The first flange 24 is connected to the second flange 56 by use of a cylindrical bridge member 72 which may include ribs 74. The bracket 14, shown in FIGS. 3 and 4, also includes the central bore 38 that extends through the bracket 14 from the first flange 24 to the second flange 56 and is adapted to receive the input shaft 16. The bridge member 72, shown in FIG. 2 includes an aperture 76 that extends radially between the outer surface 79 and the central bore 38 to allow for lubrication to reach the bushing 36. The ribs 74, shown in FIG. 2, increase the strength of the bracket 14 and provide for a means (not shown) to internally flush the outboard seal arrangement. The central bore 38 is adapted to receive the bushing 36. The central bore 38 also includes a first annular recess 66 at its other end that is adapted to receive a mechanical seal 68 illustrated in FIG. 2 or a packing material 70, as shown in FIG. 3. Since the first flange 24 and the second flange 56 have similar connecting surfaces 60, it is possible to install the bracket 14 in a reverse fashion, as shown in FIGS. 3 and 4, where the first flange 24 is connected to the bearing carrier 20 and the second flange 56 is connected to the pump housing 12. Depending upon the pump configuration or the application in which it is used, it may be desirable to position the first annular recess 66 so that it is closer to the pump housing 12, as shown in FIG. 2, so that the mechanical seal 68 or a packing material 70 can be installed in an inboard position. Alternatively, the bracket 14 can be positioned within the pump so that the first annular recess 66 is closer to the bearing carrier 20, as shown in FIG. 4, so that the mechanical seal 68 or the packing material 70, shown in FIG. 3, can be installed in an outboard position. When the mechanical seal 68 is installed in the inboard position, as shown in FIG. 2, it is biased against the rear surface 78 of the cup shaped member 18 by use of spring 80. The mechanical seal 68 prevents any fluid in the pump housing 12 from traveling through the bracket 14 and outside of the pump 10. When the mechanical seal 68 is installed in the outboard position, as shown in FIG. 4, a seal retainer 82 is fastened to the first flange 24 of the bracket 14 with bolts (not shown) to retain the mechanical seal 68 within the first annular recess 66. With this arrangement, it is possible to remove and replace the mechanical seal 68 without complete disassembly of the pump 10 when the seal 68 is in the outboard position. To change the orientation of the seal 68 from the inboard arrangement, shown in FIG. 2, to the outboard arrangement, shown in FIG. 4, the bearing carrier 20 is unbolted and disconnected from the bracket 14 by sliding the bearing carrier 20 upwardly until it is removed from the input shaft 16. The bracket 14 is then unbolted and disconnected from the pump housing 12, removed from the input shaft 16 and rotated axially 180 degrees so that the seal 68 is in the outboard position, as shown in FIG. 4. The bracket 14 is then placed onto the input shaft 16 and slid toward and reattached to the pump housing 12. The seal retainer 82 is then placed onto the input shaft 16 and connected to the bracket 14 to provide a contact surface for the seal 68. Next, the bearing carrier 20 can be reinstalled and fastened to the bracket 14. The universal bracket 14 arrangement provides for a cost effective seal 68 and bushing 36 retainer which allows one bracket 14 design to be manufactured for various pump configurations. When pumps utilize the present bracket 14, it is only necessary to inventory one bracket design that covers the inboard and outboard seal mounting arrangements.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A reversible bracket for a pump assembly including:

a first flange adapted to be connected to a pump housing;

a second flange, parallel to said first flange, and laterally displaced therefrom, said second flange adapted to be connected to a bearing carrier;

a central bore extending through said bracket, adapted to receive an input shaft extending therethrough;

a first annular recess formed in said flange, concentric with said central bore, extending laterally between a first position and a second position along said central bore, said first annular recess having a first diameter;

whereby said bracket is reversible between an inboard position and an outboard position such that in said inboard position said first annular recess is adjacent the pump housing and, when said bracket is in said outboard position, said first annular recess is adjacent to the bearing carrier.

2. The bracket of claim 1, wherein said central bore is adapted to receive a bushing.

3. The bracket of claim 1, wherein said first annular recess is adapted to receive a seal.

4. The bracket of claim 1, wherein said first annular recess is adapted to receive a packing material.

5. The bracket of claim 1, wherein said bracket includes an exterior surface that has a plurality of ribs that extend outwardly from a center section of said bracket and connect to said first flange and said second flange.

6. The bracket of claim 1, wherein said first flange and said second flange have the same connecting surfaces.

7. The bracket of claim 1 wherein said first flange includes a plurality of apertures extending therethrough to define a first bolt pattern for securing said first flange to the bearing carrier or the pump housing.

8. The bracket of claim 7 wherein said second flange includes a plurality of apertures extending therethrough to define a second bolt pattern, said second bolt pattern matching said first bolt pattern to insure reversibility of said bracket.

9. The bracket of claim 1 wherein said first annular recess has a diameter greater than said central bore.

10. A reversible bracket for a pump assembly including a pump housing and a bearing carrier said bracket including:

a first flange adapted to be connected to the pump housing;

a second flange, parallel to said first flange, and laterally displaced therefrom, said second flange adapted to be connected to the bearing carrier;

said first flange includes a plurality of apertures extending therethrough to define a first bolt pattern for securing said first flange to the bearing carrier or the pump housing;

said second flange, having a connecting surface of the same configuration as said first flange, which includes a plurality of apertures extending therethrough to define a second bolt pattern, said second bolt pattern matching said first bolt pattern to insure reversibility of said bracket;

a central bore extending through said bracket, adapted to receive an input shaft extending therethrough;

whereby said bracket is reversible between an inboard position and an outboard position such that in said inboard position said first flange is adjacent the pump housing and when said bracket is in said outboard position said first flange is adjacent to the bearing carrier.

11. The reversible bracket of claim 10, wherein said central bore is adapted to receive a bushing therein.

12. The reversible bracket of claim 10, wherein said central bore is adapted to receive a packing material therein.

13. The reversible bracket of claim 10, wherein said central bore is adapted to receive a mechanical seal wherein.

14. The reversible bracket of claim 10, wherein said central bore includes a first annular recess.

15. The reversible bracket of claim 14, wherein said first annular recess has a diameter greater than said central bore.

* * * * *